US011709041B2

(12) United States Patent
Saltz

(10) Patent No.: US 11,709,041 B2
(45) Date of Patent: Jul. 25, 2023

(54) LOW-OBSERVABLE PROJECTILE

(71) Applicant: Gregory Saltz, Fort Worth, TX (US)

(72) Inventor: Gregory Saltz, Fort Worth, TX (US)

( * ) Notice: Subject to any disclaimer, the term of this patent is extended or adjusted under 35 U.S.C. 154(b) by 153 days.

(21) Appl. No.: 17/471,089

(22) Filed: Sep. 9, 2021

(65) Prior Publication Data

US 2022/0107164 A1 Apr. 7, 2022

Related U.S. Application Data

(63) Continuation of application No. 16/591,922, filed on Oct. 3, 2019, now Pat. No. 11,150,064, which is a continuation of application No. 15/698,543, filed on Sep. 7, 2017, now Pat. No. 10,480,916.

(51) Int. Cl.

| | |
|---|---|
| ***F42B 12/80*** | (2006.01) |
| ***F42B 5/02*** | (2006.01) |
| ***F42B 5/045*** | (2006.01) |
| ***F42B 14/06*** | (2006.01) |
| ***F42B 15/34*** | (2006.01) |
| ***F42B 6/00*** | (2006.01) |
| ***F42B 12/76*** | (2006.01) |
| *F42B 15/00* | (2006.01) |

(52) U.S. Cl.

CPC ..... *F42B 12/80* (2013.01); *F42B 5/02* (2013.01); *F42B 5/045* (2013.01); *F42B 6/006* (2013.01); *F42B 12/76* (2013.01); *F42B 14/06* (2013.01); *F42B 14/064* (2013.01); *F42B 14/068* (2013.01); *F42B 15/34* (2013.01); *F42B 15/00* (2013.01)

(58) Field of Classification Search

CPC .... F42B 5/02; F42B 5/045; F42B 5/10; F42B 5/105; F42B 6/006; F42B 12/76; F42B 12/80; F42B 12/82; F42B 14/00; F42B 14/06; F42B 14/064; F42B 14/068; F42B 15/00; F42B 15/10; F42B 15/105; F42B 15/34; F42B 15/36

USPC ..... 102/520, 521, 522, 523

See application file for complete search history.

(56) References Cited

U.S. PATENT DOCUMENTS

| | | | |
|---|---|---|---|
| 3,599,210 | A | 8/1971 | Stander |
| 3,905,299 | A | 9/1975 | Feldmann |
| 3,948,184 | A | 4/1976 | Pierre |
| 4,142,467 | A | 3/1979 | Stahlmann |

(Continued)

FOREIGN PATENT DOCUMENTS

| | | | |
|---|---|---|---|
| CN | 102584199 | 7/2012 | |
| DE | 4216837 | 11/1993 | |
| RU | 2625056 C1 * | 7/2017 | ..... F42B 12/76 |

OTHER PUBLICATIONS

Machine translation of RU-2625056-C1 (Year: 2017).*

(Continued)

*Primary Examiner* — James S Bergin

(74) *Attorney, Agent, or Firm* — Fitch, Even, Tabin & Flannery LLP

(57) ABSTRACT

A radar-absorbing material projectile system including a projectile with an outer layer of radar-absorbing material (RAM). A carrier or armature is disposed around the projectile, protecting the layer of RAM during the firing sequence. In some embodiments the carrier is a discarding carrier which falls away after firing, rendering the projectile low-observable with regard to radar detection due to the layer of RAM.

13 Claims, 5 Drawing Sheets

(56) References Cited

U.S. PATENT DOCUMENTS

| | | | | |
|---|---|---|---|---|
| 4,476,785 | A | 10/1984 | Hoffman | |
| 4,606,848 | A | 8/1986 | Bond | |
| 4,976,202 | A | 12/1990 | Honigsbaum | |
| 5,340,058 | A * | 8/1994 | Holl | F42B 12/76 244/121 |
| 5,353,711 | A | 10/1994 | Botticelli | |
| 5,493,974 | A | 2/1996 | Bilgeri | |
| 5,717,397 | A | 2/1998 | Ruszkowski, Jr. | |
| 5,786,785 | A | 7/1998 | Gindrup | |
| 5,892,476 | A | 4/1999 | Gindrup | |
| 6,060,411 | A | 5/2000 | Cline | |
| 6,867,725 | B2 | 3/2005 | Breeden | |
| 6,909,395 | B1 | 6/2005 | Carpenter | |
| 8,097,838 | B2 | 1/2012 | Torsten | |
| 8,115,149 | B1 | 2/2012 | Manole | |
| 8,325,079 | B2 | 12/2012 | Shah | |
| 8,601,965 | B2 | 12/2013 | Shah | |
| 8,662,449 | B2 | 3/2014 | Shah | |
| 9,236,660 | B2 * | 1/2016 | Nyght | F41H 11/02 |
| 9,279,651 | B1 | 3/2016 | Goldberg | |
| 9,528,806 | B2 | 12/2016 | Rossmann | |
| 10,480,916 | B1 | 11/2019 | Saltz | |
| 11,150,064 | B2 | 10/2021 | Saltz | |
| 2009/0090809 | A1 | 4/2009 | Ronn | |
| 2011/0135491 | A1 | 6/2011 | Shah | |
| 2014/0292553 | A1 | 10/2014 | Nyght | |
| 2019/0017792 | A1 | 1/2019 | Kezerian | |
| 2020/0166319 | A1 | 5/2020 | Saltz | |

OTHER PUBLICATIONS

Saltz; U.S. Appl. No. 16/591,922 filed Oct. 3, 2019.
Saltz; U.S. Appl. No. 15/698,543, filed Sep. 7, 2017.
USPTO; Notice of Allowance for U.S. Appl. No. 16/591,922 dated Aug. 5, 2021.
USPTO; Examiner Interview Summary for U.S. Appl. No. 15/698,543 dated Apr. 5, 2019.
USPTO; Non-Final Office Action for U.S. Appl. No. 15/698,543 dated Feb. 6, 2019.
USPTO; Notice of Allowance for U.S. Appl. No. 15/698,543 dated Aug. 20, 2019.
USPTO; Restriction Reguirement for U.S. Appl. No. 15/698,543 dated Sep. 4, 2018.

* cited by examiner

LOW-OBSERVABLE PROJECTILE

This application is a continuation of U.S. application Ser. No. 16/591,922, filed Oct. 3, 2019, for LOW-OBSERVABLE PROJECTILE, which is a continuation of U.S. application Ser. No. 15/698,543, filed Sep. 7, 2017, for LOW-OBSERVABLE PROJECTILE, now U.S. Pat. No. 10,480,916, both of which are incorporated in their entirety herein by reference.

BACKGROUND OF THE INVENTION

Field of the Invention

The present invention relates generally to artillery projectiles, and more specifically to artillery projectiles including stealth technology.

Discussion of the Related Art

The interception of, and destruction of, incoming projectiles has become a continuously advancing art. The increasing precision of radar detection and tracking have caused close-in point-defense weaponry as well as longer range missile-based enemy projectile interception to become not only feasible, but commonplace in the various domains of modern warfare throughout the world. Additionally, laser target defense systems are under development, which may be highly effective once deployed. While a success for defense, the ability to offensively penetrate an opponent's "defensive net" becomes an increasingly difficult offensive challenge.

Additionally, vehicles are increasingly incorporating stealth technology, such as the USS ZUMWALT destroyer. A conventional projectile launched from a stealth vehicle would potentially expose the stealth vehicle to enemy attack due to the opponent tracking the projectile back to the vehicle ("counter-battery fire").

One of the only current means by which the "defensive net" of a radar-equipped opponent can be reliably penetrated is with the use of stealth technology to lower the observability of the projectile. One type of stealth technology is radar-absorbing material (RAM). Previous generations of projectiles did not allow for a truly stealthy weapon as a result of numerous factors, for example a non-powered projectile (as opposed to a powered projectile powered by a rocket, turbo-fan or other suitable apparatus) would have its external coating of RAM either partially or completely scraped off due to the contact of the projectile with the bore of the artillery piece that was firing it, and a powered projectile would have an observable and trackable thermal signature due to the heat of its motor and exhaust.

SUMMARY OF THE INVENTION

Several embodiments of the invention advantageously address the needs above as well as other needs by providing a projectile including an exterior layer of radar-absorbing material covering an exterior surface of the projectile; and a carrier disposed around the projectile and configured to detach and fall away from the payload after firing of the projectile while leaving the layer of radar-absorbing material intact, whereby the projectile is low-observable for radar detection.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
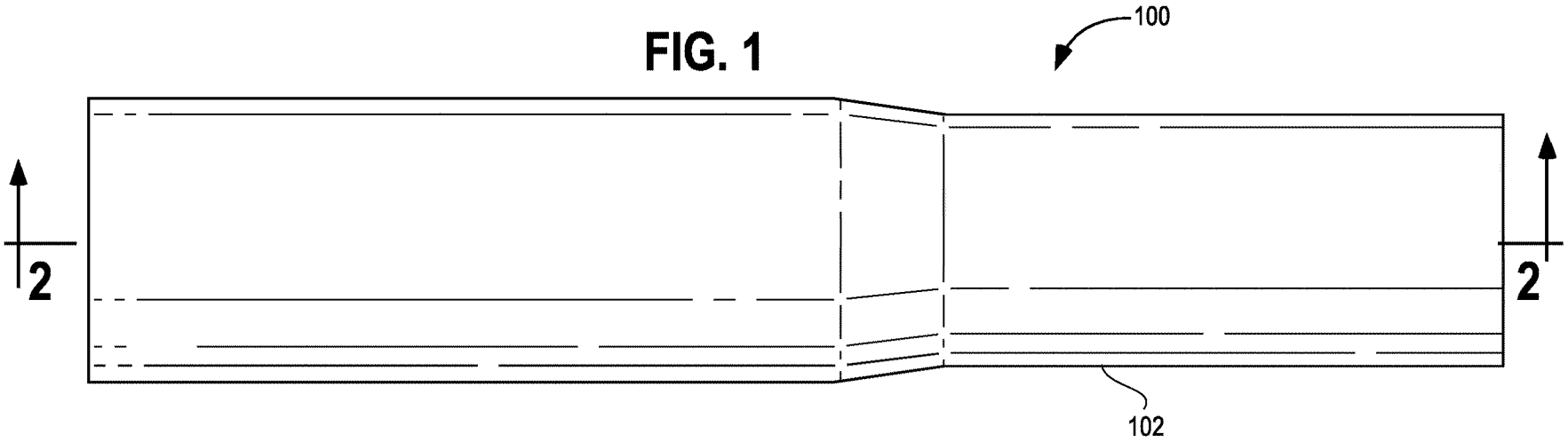
FIG. 1 is a top view of a radar-absorbing material (RAM) projectile system in a first embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 2:
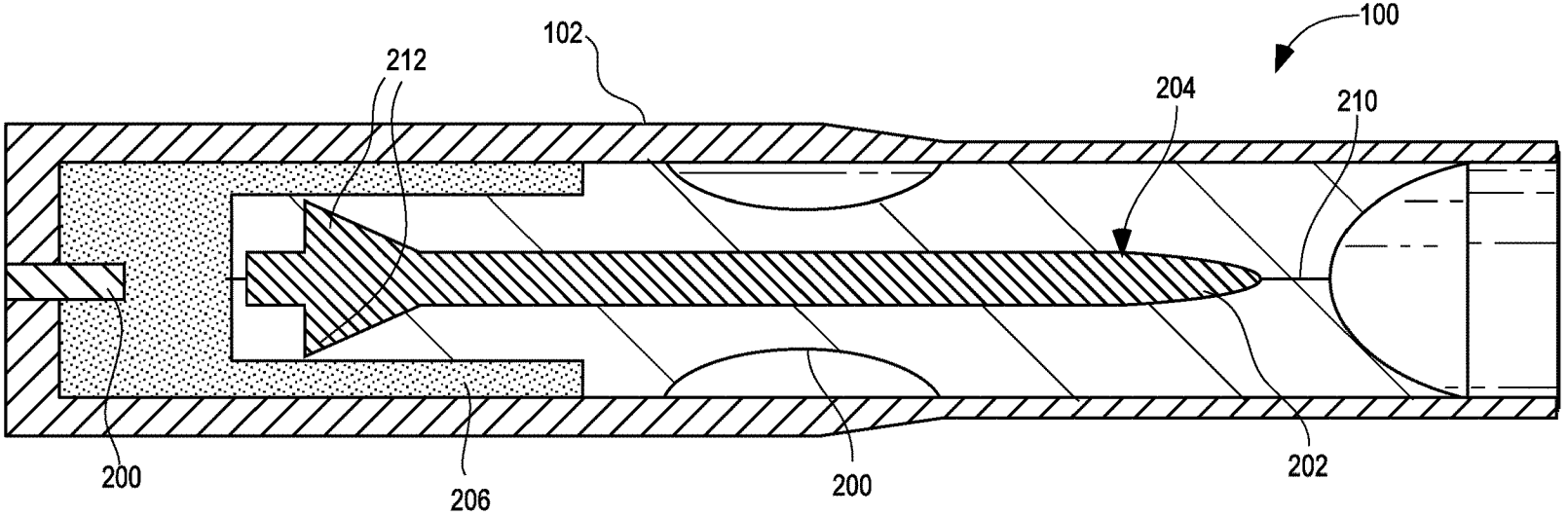
FIG. 2 is a sectional view of the RAM projectile system of FIG. 1.
Figure 3:
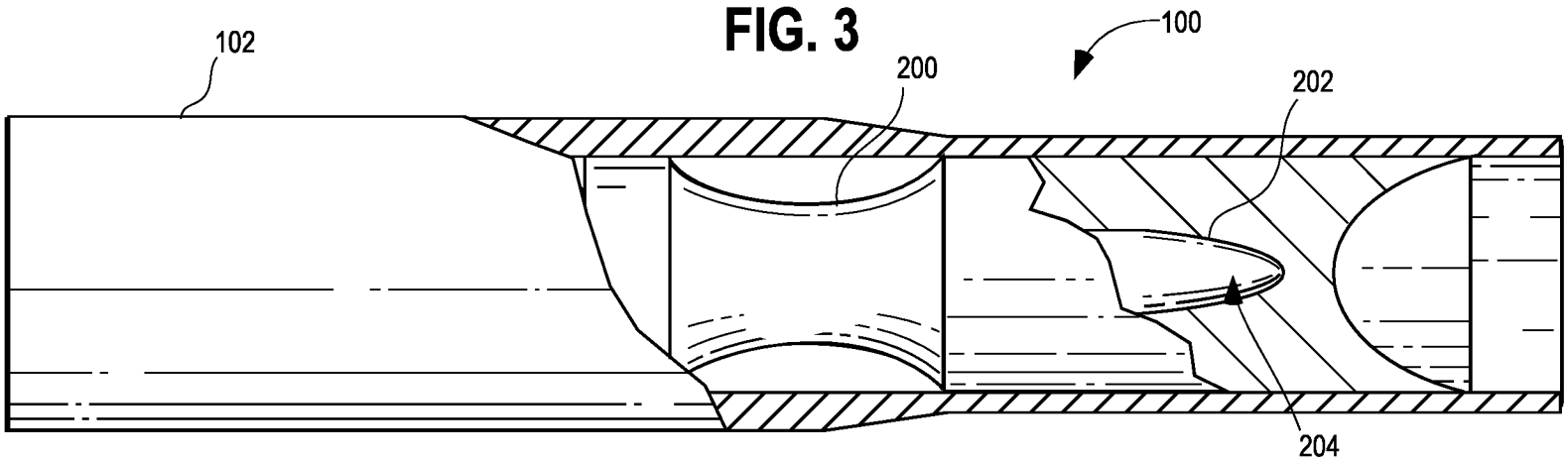
FIG. 3 is a cutaway view of the RAM projectile system of FIG. 1.

Referring first to FIGS. 1-3, a top view, a sectional view, and a cutaway view (respectively) of a radar-absorbing material (RAM) projectile system 100 in a first embodiment of the present invention are shown. Shown are a casing 102, a carrier 200, a projectile 202, a RAM layer 204, a propellant 206, a primer 208, a seam 210, and flight elements 212.

The projectile 202 is configured to be fired from an artillery piece. The projectile may be configured for various purposes, including any combination of armor penetration, general purpose artillery, and anti-personnel. The internal design of the projectile 202 is thus dependent on the desired characteristics of the projectile 202. In the embodiment shown in FIGS. 1-3, the projectile 202 is a fin-stabilized, non-powered (i.e. the motion of the projectile 202 after firing is not assisted by powered elements such as a rocket or a turbo-fan), conically-shaped projectile configured to arc in a standard trajectory. Additional types of projectiles are also contemplated, as shown in additional embodiments, and as known by those of ordinary skill in the art. For example, boosted projectiles, glide projectiles, non-finned projectiles, and configurations to include elements such as explosives, detonation mechanisms, transceivers, propellants, fragmentation mechanisms, guidance systems, etc. In the embodiment shown, the projectile 202 includes optional flight elements 212, represented in FIG. 2 as thin triangular fins 212 extending outward from the generally cylindrical body of the projectile 202. It will be understood by those of ordinary skill in the art that other types and combinations of flight elements 212 may be included in the projectile 202, for example, wings, wing flaps, rudders, stabilizers and/or or other types of flight elements 212. In one embodiment the flight elements 212 are configured to allow the projectile to act as a glider. The size and shape of the carrier 200 and the casing 102 may be modified as required to accommodate the dimensions of the flight elements 212. The RAM layer 204 is configured to fully cover any flight elements 212 of the projectile 202.

The projectile 202 is entirely encased by the RAM layer 204. The RAM layer 204 comprises a radar-absorbing material configured to absorb incident radar waves as effectively as possible. Any type of RAM known in the art and compatible with effective application to the entire surface of the projectile 202 is suitable. Thickness of the RAM layer 204 is dependent on the type of RAM used and durability requirements.

In one embodiment, iron ball paint may comprise the radar-absorbing material. Iron ball paint includes microspheres coated in or comprised of carbonyl iron or ferrite (or other suitable magnetic material), coated in an insulator (e.g. quartz), and suspended in an epoxy. The iron ball paint is painted onto the surface, and while still liquid, magnetic fields of specific strengths are applied to create magnetic field patterns in the microspheres of the iron ball paint. The iron ball paint then hardens, holding the microspheres in the desired pattern. In some embodiments the iron ball paint is utilized in a two-layer fashion with a first (inner) layer with a higher density of microspheres to absorb the radiation and convert it to heat and a second (outer) layer including a relatively low density of microspheres to allow radar waves to pass through preventing reflection. For use in the RAM projectile system 100, the projectile 202 would be painted with the iron ball paint.

In another embodiment of RAM, carbon nanotubes (CNT) are infused into a fibrous material (e.g. glass, silicon carbide, poly-paraphenylene terephthalamide, etc.,) which is in turn disposed in a matrix material, forming a composite material. The CNT are grown on the fibrous material in such a way that the density, length, and orientation can be controlled. The CNT-infused fiber can then be combined with one or more materials for greater mechanical strength as well as other desirable properties. The CNT composite material in typical embodiments is coupled to the outer surface of the projectile 202 during construction of the projectile, as opposed to the iron ball paint which may be applied as a paint to a finished projectile.

As with the iron ball paint, the CNT composite material may be arranged in two layers: the outer (second) layer including a relatively low density of CNT to allow radar waves to pass through preventing reflection, and the inner (first) layer with a higher density of CNT to absorb the radiation and convert it to heat. The overall density and thickness of the CNT composite material depends on the materials selected as well as how much of the projectile/RAM layer assembly is devoted to the RAM layer 204.

The carrier 200 is disposed about the RAM layer-encased projectile 202. The carrier 200 may encase the projectile 202, as shown in FIGS. 1-3, or the carrier 200 may partially encase the projectile 202. The carrier 200 prevents the RAM layer 204 from being in dynamic contact with any surfaces that could strip off some or all of the RAM layer 204. As typically known in the art, the carrier is configured to be secured to and protect the projectile before firing and as the projectile travels down a bore of the artillery piece during firing. In the embodiment shown in FIGS. 1-3 the carrier is a discarding sabot-type carrier (a bisecting sabot, with the seam 210 between the two sabot pieces as partially shown in FIG. 2). Other types of discarding carriers (trisecting sabots, etc.) are also contemplated. The discarding carrier 200 is configured to fall away from the projectile after firing. The carrier may be designed to induce separation due to air resistance or by other means as is commonly known in the art. The carrier 200 is configured such that the separation does not unacceptably affect the projectile 202 or a flight path of the projectile 202.

The carrier 200 may also be configured to provide mechanical and thermal insulation for the projectile based on the field conditions and type of artillery. Factors may include amount of pressure experienced by the carrier, acceleratory forces, temperatures the carrier will be subjected to, length of barrel, caliber of bore, amount of propellant used, rate of fire, etc. In cases where forces and heat are low enough to not cause thermal damage to the RAM layer 204 and not cause mechanical failure in the carrier 200, the carrier 200 could be made of a simple metal alloy such as steel, titanium, or aluminum. If a metal alloy does not provide enough strength, a more complex material may be used such as a carbon fiber-reinforced polymer.

In other embodiments requiring more thermal protection, a layer of more thermally insulative material may be included in an inner layer of the carrier 200. Thermally insulative material used may include manganese, polyurethane, polytetrafluoroethylene, and aerogels. The thermally insulative material and its location within the carrier is selected to prevent mechanical failure (e.g. due to intense g-forces during firing) and/or unacceptably fast degradation of the RAM layer 204, other components of the carrier 200, or the thermally insulative material itself.

In some embodiments, the carrier 200 also has low observability/trackability characteristics in order to further reduce the likelihood that the location of the artillery piece will be revealed. Carrier low observability/trackability characteristics could be included by the use of certain geometries which return a smaller radar signature, visible carrier surfaces including a dielectric material, etc.

The casing 102 is disposed around the carrier 200, and is configured to protect the carrier/projectile assembly prior to firing and for loading into the bore. The casing 102 also provides a housing for the propellant 206 and the primer 208 used in the firing of the projectile. The casing 102 is retained within the bore after firing, and then discarded.

During firing, the projectile/carrier assembly is forced down the bore in a manner consistent with conventional projectile systems. The carrier 200 protects the projectile from being in dynamic contact (experiencing a shearing force) within the bore. The carrier 200 also prevents, in standard artillery systems, any portion of the RAM layer 204 from being removed by forceful expanding gasses of the propellant undergoing combustion. The carrier 200 also acts as a thermally insulating barrier that prevents any portion of the RAM layer 204 from being burned off.

After leaving the bore, the carrier 200 comes apart and falls away from the projectile 202, leaving the RAM layer 204 intact. The projectile 202 then continues to travel downrange with the RAM layer 204 providing low observability for radar waves.

Referring again to FIGS. 1-3, the RAM projectile system 100, as compared to a non-stealthy projectile, has a greater ability to penetrate defensive nets comprised of long-range interceptors (missiles) and point-defense weaponry (close-in weapon systems). The quintessential example of where such defensive nets are employed is on modern naval warships, although other examples exist such as shore installations of great value, e.g. a command and control facility.

A stealthy projectile system, such as the RAM projectile system 100 disclosed herein, grants the option to a stealthy platform, such as a stealth naval destroyer, to exercise offensive maneuvers using projectiles while reducing the likelihood that the stealthy platform can be tracked and/or attacked via counter-battery fire: the tracking of an incoming projectile, typically via radar, back to its origin so as to be able to determine where the enemy platform fired from.

As the RAM projectile system 100 can utilize standard casings, the RAM projectile system 100 can be used with existing artillery platforms without requiring modification of the platforms. Examples of platforms compatible with the RAM projectile system 100 include the Advanced Gun System of the ZUMWALT destroyer, the Mark 45 5-inch gun, and the M777 howitzer.

Figure 4:
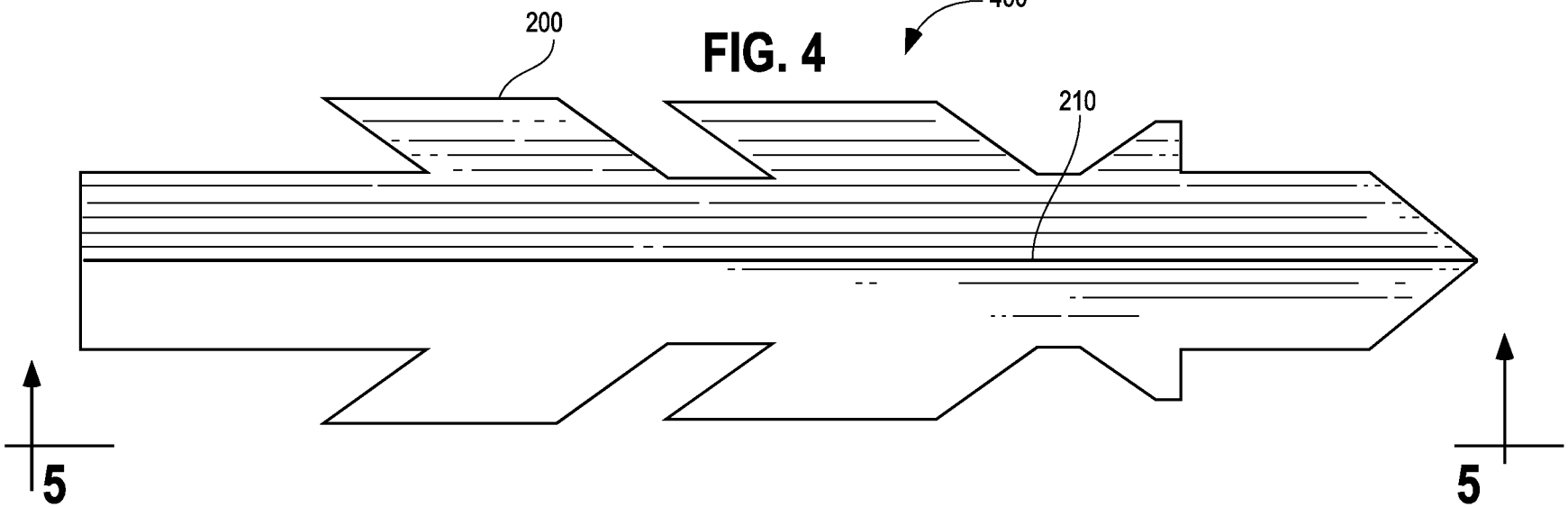
FIG. 4 is a top view of a radar-absorbing material (RAM) projectile system in a rail gun embodiment of the present invention.
Figure 5:
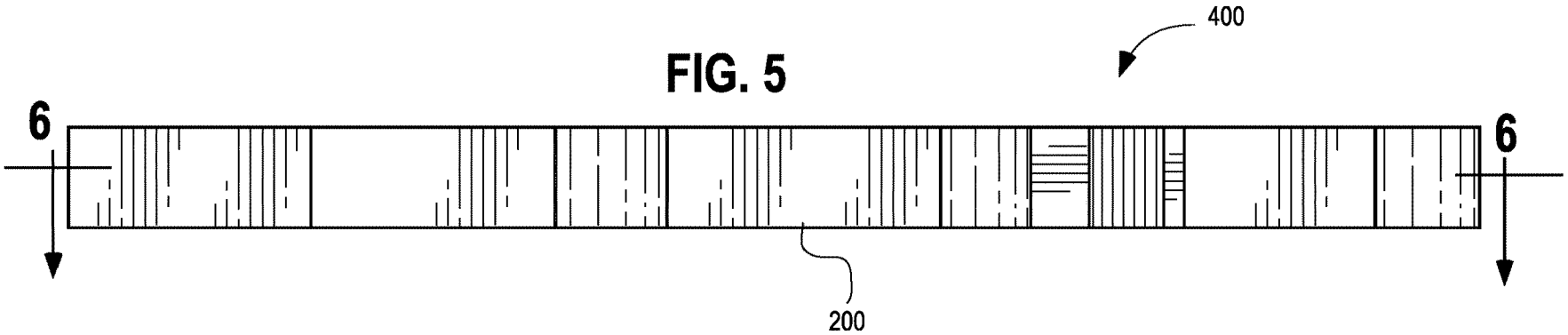
FIG. 5 is a side elevational view of the RAM projectile system of FIG. 4.
Figure 6:
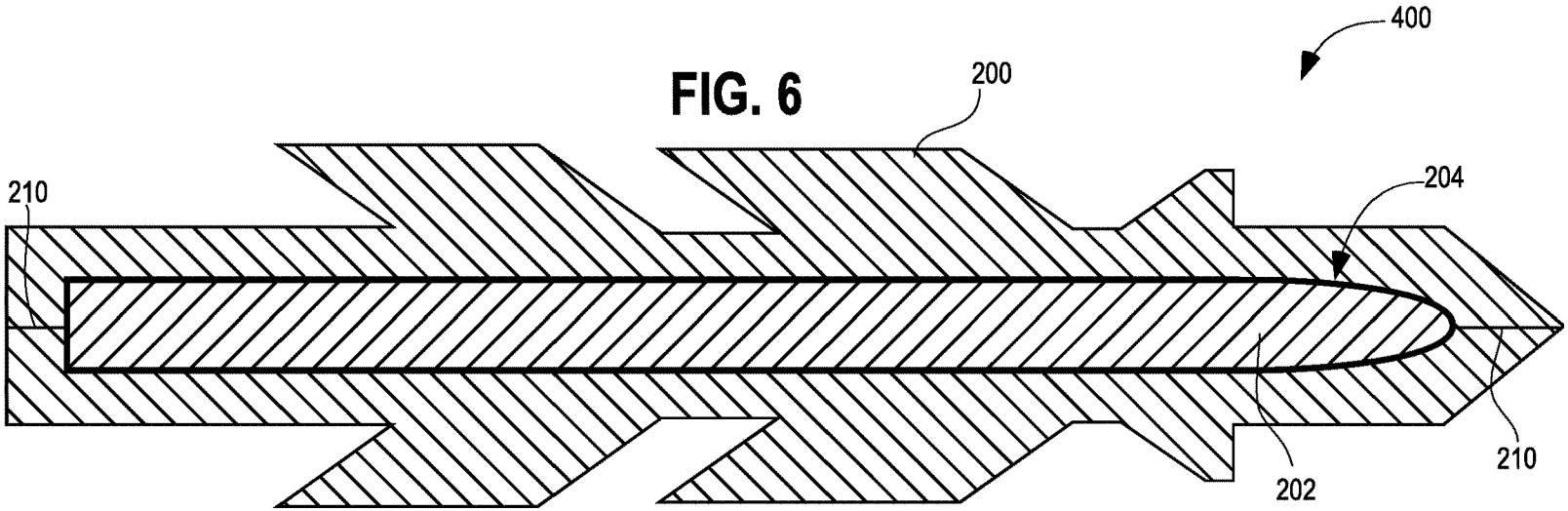
FIG. 6 is a sectional view of the RAM projectile system of FIG. 4.

Referring next to FIGS. 4-6, a top view, a side elevational view, and a sectional view (respectively) of a radar-absorbing material (RAM) projectile system 400 in a second embodiment of the present invention are shown. Shown are the carrier 200, the projectile 202, the RAM layer 204, the seam 210, a carrier inner layer 600, and a carrier outer portion 602.

The embodiment shown in FIGS. 4-6 is directed towards use in a rail gun. As known in the art, a rail gun induces electromagnetic forces on a projectile interposed between two parallel rails. The forces propel the projectile along the rails, launching it from the end of the rails. There is no casing used in the rail gun embodiment.

The discarding carrier 200 is configured for use with the rail gun system, while still configured for discarding after firing as previously described. In the present embodiment, the carrier 200 is comprised of the outer portion 602 and the inner layer 600. The inner layer 600 is configured to surround the projectile 202. In some embodiments, the inner layer 600 has a thickness of approximately 1-10 mm. For the rail gun embodiment, the material of the outer portion 602 is configured to offer relatively low electrical resistance so as to allow for current to efficiently pass through the carrier 200. The carrier 200 in the present embodiment also includes the separate insulating inner layer 600 comprising highly electrically insulative material. The insulating layer 600 is interposed between the carrier outer portion 602 and the projectile 202. The inner layer 600 surrounds the projectile 202 and is configured to prevent current from passing through the projectile 202 and damaging the RAM layer 204, amongst other possible issues. Suitably strong and thermally insulative materials for the inner layer 600 may include polytetrafluoroethylene, polyethylene terephthalate or other suitable polymer or ceramic.

In some embodiments, the projectile 202 may be a hypervelocity projectile with an appropriate geometry.

Figure 7:
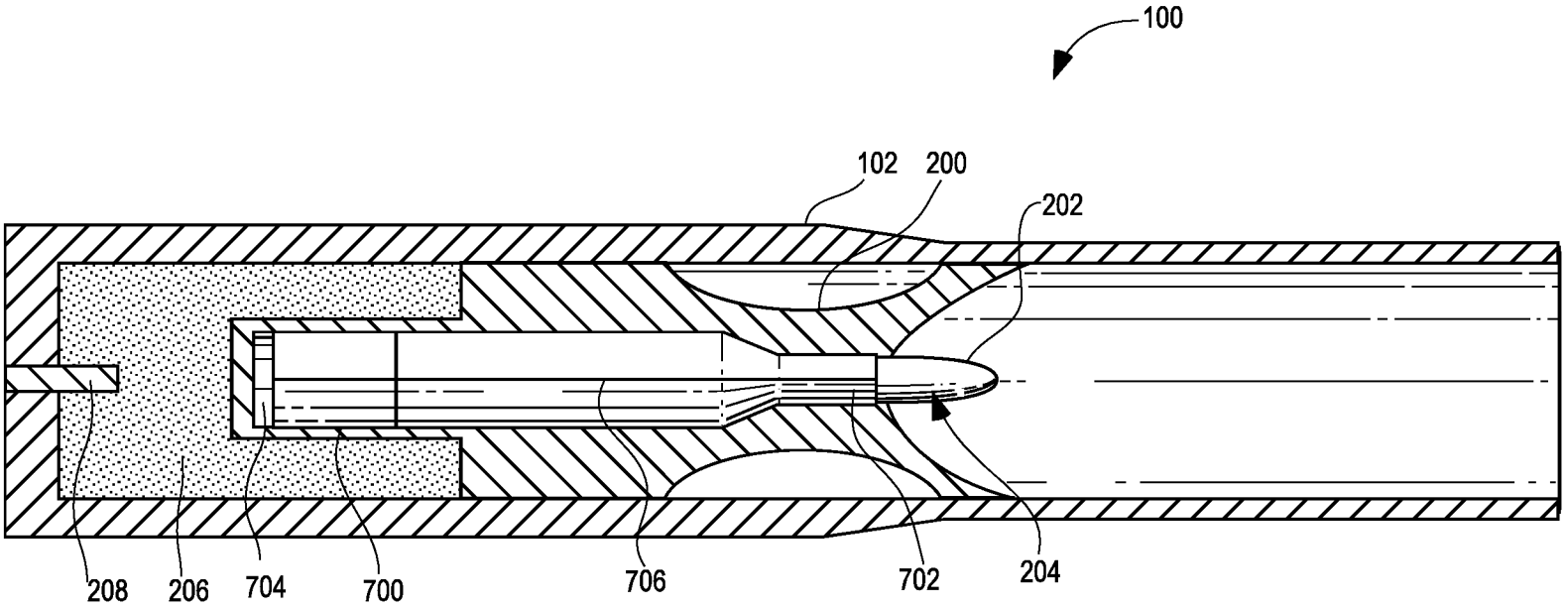
FIG. 7 is a cutaway view of a RAM projectile system in a boosted embodiment of the present invention.

Referring next to FIG. 7, a cutaway view of the RAM projectile system 100 adapted for a boosted projectile is shown. Shown are the casing 102, carrier 200, the projectile 202, the RAM layer 204, the propellant 206, the primer 208, the seam 210, a rocket sub-assembly 700, an aerodynamic sheath 702, a base plate ring 704, and a sheath seam 706.

As shown in FIG. 7, the RAM projectile system 100 may be used with a variety of projectile configurations, including with a boosted (i.e. powered) projectile. The entire projectile 202 is covered with the RAM layer 204 as previously described. A rear portion of the projectile 202 is encased with the aerodynamic sheath 702. The rocket sub-assembly 700 including the base plate ring 704 is removably coupled to the projectile 202 and the aerodynamic sheath 702. The discarding carrier 200 of any suitable configuration is disposed around the projectile 202, aerodynamic sheath 702 and rocket sub-assembly 700 as shown in FIG. 7.

During firing, similar to that described in FIGS. 1-3, the RAM projectile system 100 is pushed down the bore of the artillery piece by the combustion of the propellant 206. After exiting the bore, the carrier 200 is discarded as previously described. After this, a rocket motor of the rocket sub-assembly 700 activates, supplying additional propulsion. The rocket motor typically, although not necessarily, shuts off after a period of time. At a certain time, the aerodynamic sheath 702 peels and falls away from the projectile by separating along the sheath seam 706. The rocket sub-assembly 700 also detaches from the projectile 202 and falls away.

The RAM projectile system 100 including additional boosting components has the advantage of extended range, although during the boosted/powered portion of the projectile flight, the projectile 202 is non-stealthy as the rocket sub-assembly 700 may be detected during operation. After discarding of the sheath 702 and the rocket sub-assembly 700, additional post-boost actions would typically take place in order to ensure the stealthiness of the projectile 202. For example, after detaching of the rocket sub-assembly 700, electrically-powered actuators would move components covered in RAM in place where the rocket sub-assembly 700 was attached, returning the projectile 202 to a stealthy overall surface and shape.

Figure 8:
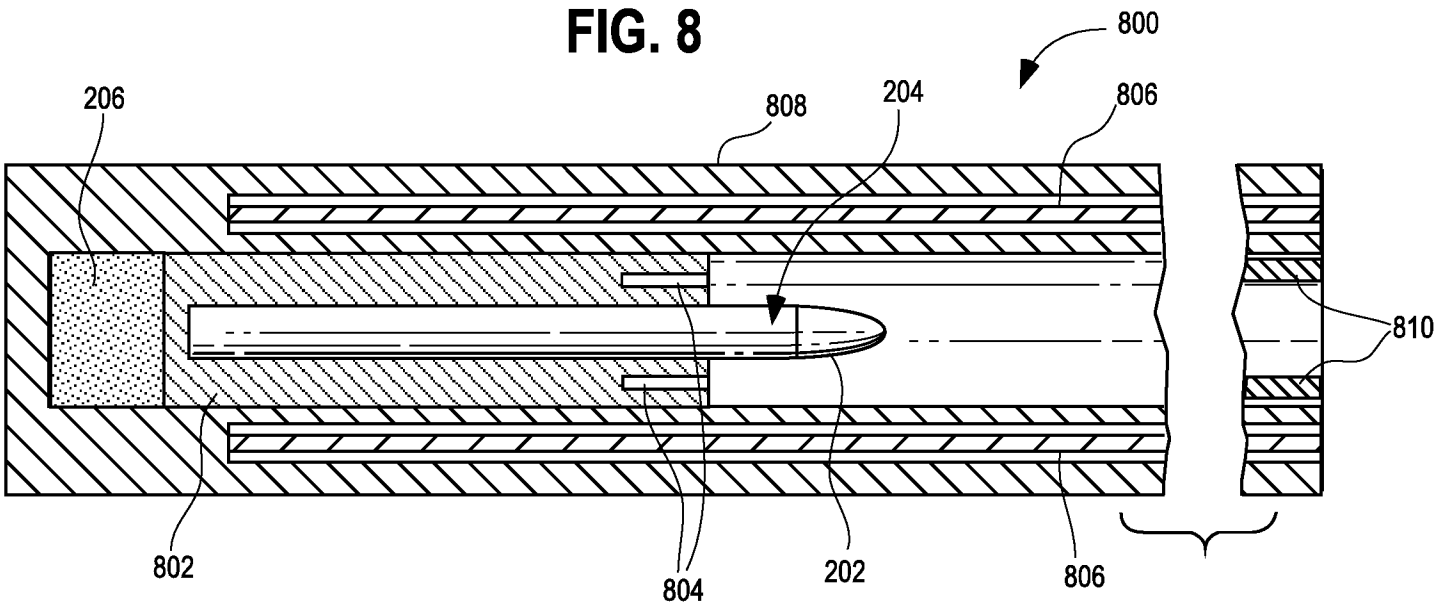
FIG. 8 is a cutaway view of a RAM projectile system in a non-discarding armature embodiment of the present invention.

Referring next to FIG. 8, a cutaway view of a RAM projectile system 800 in yet another embodiment of the present invention is shown. Shown are the projectile 202, the RAM layer 204, the propellant 206, a non-discarding armature 802, reset recesses 804, reset rods 806, a barrel 808, and reset plugs 810.

In the non-discarding armature embodiment of FIG. 8, the armature 802 remains in the barrel 808 after firing. The projectile 202 is covered with the RAM layer 204 as previously described. The armature 802 is installed in the barrel 808, and configured to receive the projectile 202 and carry it forward through the barrel 808 during the firing sequence. The armature 802 protects the RAM layer 204 of the projectile 202 during the firing sequence. As commonly known in the art, during firing the combustion of the propellant 206 forces the armature 802 and projectile 202 forward. When the armature 802 is proximate to the end of the barrel 808, stoppers (not shown) in the barrel 808 engage spring-containing pistons (not shown) of the armature 802, resulting in the stopping of the forward movement of the armature 802, while the projectile 202 leaves the armature 802 and is fired from the barrel 808. The reset plugs 810 are inserted into the reset recesses 804 of the armature 802. The reset plugs 810 (and thus the armature 802) are drawn rearward towards the breech of the barrel 808 by the reset rods 806, which are connected to the aforementioned reset plugs 810, whereby the armature 802 is reset to receive another projectile 202.

While the invention herein disclosed has been described by means of specific embodiments, examples and applications thereof, numerous modifications and variations could be made thereto by those skilled in the art without departing from the scope of the invention set forth in the claims.

What is claimed is:

1. A projectile system comprising:

a projectile including an exterior layer of radar-absorbing material fully covering an exterior surface of the projectile, wherein the radar-absorbing material is a carbon nanotube-infused composite material applied to the surface of the projectile such that the carbon nanotube-infused composite material is radar-absorbing; and a carrier disposed around the projectile configured to provide a thermally insulating barrier preventing any portion of the radar-absorbing layer being burned off during firing of the projectile system and configured to detach and fall away from the projectile after firing of the projectile system while leaving the layer of radar-absorbing material intact, whereby the projectile is low-observable for radar detection after firing.

2. The projectile system of claim 1 further comprising a casing disposed around the carrier and configured to be held within a barrel prior to firing of the projectile.

3. The projectile system of claim 1, wherein the carbon nanotube-infused composite material is applied to the surface in an inner first layer and an outer second layer.

4. The projectile system of claim 1, wherein the first layer has a higher density of carbon nanotubes than the second layer.

5. The projectile system of claim 1, wherein the projectile is non-powered.

6. The projectile system of claim 5, wherein the projectile includes at least one flight control element.

7. The projectile system of claim 1, wherein the carrier comprises a thermally insulative material.

8. The projectile system of claim 7, wherein the thermally insulative material comprises at least one of manganese, polyurethane, polytetrafluoroethylene, and aerogel.

9. The projectile system of claim 1, wherein the carrier comprises a metal alloy.

10. The projectile system of claim 1, wherein the carrier is configured to include at least one low-observable characteristic.

11. The projectile system of claim 1, wherein the carrier completely encases the projectile.

12. The projectile system of claim 1, wherein the carrier partially encases the projectile.

13. The projectile system of claim 1, wherein the carrier is a sabot-type discarding carrier.

* * * * *